United States Patent [19]

Owen

[11] 4,311,977

[45] Jan. 19, 1982

[54] OUTPUT TRANSFORMER

[75] Inventor: Kenneth Owen, Dallas, Tex.

[73] Assignee: Continental Electronics Mfg. Co., Dallas, Tex.

[21] Appl. No.: 154,207

[22] Filed: May 29, 1980

[51] Int. Cl.[3] ..... H01F 15/14; H01F 27/28

[52] U.S. Cl. ..... 336/69; 336/180; 336/183

[58] Field of Search ..... 336/69, 70, 180, 181, 336/182, 183, 185, 171, 170; 323/48, 49; 330/171, 190, 197

[56] References Cited

U.S. PATENT DOCUMENTS

| | | | |
|---|---|---|---|
| 2,077,981 | 4/1937 | Bergen | 336/185 |
| 2,477,074 | 7/1949 | McIntosh | 336/183 X |
| 2,680,218 | 6/1954 | Keroes | 336/183 |
| 2,791,646 | 5/1957 | Keroes | 336/183 X |
| 2,815,408 | 12/1957 | Hafler | 336/183 X |
| 2,971,173 | 2/1961 | Kajihara | 336/170 |
| 3,061,804 | 10/1962 | Bereskin | 336/183 X |
| 3,168,715 | 2/1965 | Woodworth | 336/170 X |
| 3,173,112 | 3/1965 | Welch | 336/180 X |
| 3,576,505 | 4/1971 | Seidel | 336/170 X |
| 3,579,165 | 5/1971 | Johnson | 336/182 |

FOREIGN PATENT DOCUMENTS

| | | | |
|---|---|---|---|
| 956638 | 4/1964 | United Kingdom | 336/180 |

*Primary Examiner*—Thomas J. Kozma
*Attorney, Agent, or Firm*—Nolte and Nolte

[57] ABSTRACT

An output transformer, especially useful to couple a balanced output stage to an unbalanced load, employs first and second primary winding halves, which have their "center taps" physically offset, and wherein the windings are wound coextensively for some but not all of their length. The secondary winding is wound coextensively with one or the other of the two primary halves, thereby improving the coupling and reducing leakage inductance and also reducing the interlayer volt amperes and thus reducing interlayer capacitance.

12 Claims, 3 Drawing Figures

OUTPUT TRANSFORMER

BACKGROUND OF THE INVENTION

The present invention relates to transformers and, more specifically, to output transformers of the type for use with push-pull audio amplifiers.

The advantages gained by the use of a push-pull amplifier have been well known since almost the beginning of the use of vacuum tube power amplifiers. In a push-pull circuit one tube amplifies the positive half of the signal while the other tube amplifies the negative half of the input signal, and both halves are ultimately combined in the secondary of the output transformer. It is this output transformer that has been the principal limitation on the usefulness and applicability of the push-pull amplifier. More specifically, the transformer involves restricted bandwidth and introduces switching-transient related distortion. Thus, although the push-pull power amplifier may be constructed using conventional, simple components and an extremely simple circuit arrangement, the functional limitations of the output transformer have limited its usefulness.

The design goals which would make the output transformer the most efficient and most desirable are readily identifiable; however, the design approach to meeting these goals is generally considered to involve mutually exclusive elements. For example, it is known that for optimum efficiency in class B operation, each side of the push-pull circuit, which includes a transformer winding and an amplification device, such as a power transistor or a power vacuum tube, is alternately driven into the conductive state for approximately 180° of the input signal. This has the effect that during a complete amplification cycle the current flow in each side of the push-pull circuit must switch on and off at the appropriate instant. Therein lies the problem in such transformer design, since this kind of switching is not an inherent characteristic of transformers.

Additionally, further problems are presented in the design of such output transformers by the fact that each side of the push-pull circuit constitutes a separate generator of opposite polarity. Each generator operates only during its "turned-on" portion of the cycle during the time the other side is turned off or open by means of the appropriate amplifying device in the push-pull amplification circuit. Thus, each side of the input portion of the transformer must be designed to match separately the load impedance. Therefore, it is necessary for the output transformer in a push-pull circuit to have a primary winding which has an end-to-end impedance of four times that of a single winding which might otherwise match the generator-to-load impedance. Looking at this another way, the load resistance will be the resistance seen when looking into one half of the primary of the output transformer, Thus, if each half of the total number of turns on the primary equals the number of turns on the secondary, the load resistance looking into half of the primary would be equal to that of the actual load which might be connected to the output. Nevertheless, since reflected resistance is proportional to the square of the turns ratio, the load resistance as seen across the total primary winding would be four times the actual load resistance.

This raises another problem presented, for example, by class B push-pull output transformers, in that it is important to maintain equal coupling between each half of the push-pull primary winding and the secondary or load winding over the entire frequency band of interest. Failure to accomplish equal coupling between such windings results in unbalanced loading of the output tubes or transistors of the class B push-pull amplifier, possibly causing damage to these components. In any event, such unequal coupling generates both phase and amplitude distortion in the output waveform.

SUMMARY OF THE INVENTION

The present invention teaches an output transformer having a specialized winding arrangement such that two primary windings are provided which are "offset" by a certain amount, whereby the coupling between the windings is greatly improved. The present invention teaches a winding distribution which is such that the two halves of the primary winding are specially arranged in proximity so as to improve the mutual coupling, whereby the segments of these two opposite polarity windings proximate each other are those segments wherein the lowest potential differences with respect to each other are located. This further reduces any reactive current circulation in the windings, thus improving the bandwidth. The secondary or output winding is wound coextensively with one or the other of the two input primary windings and may be provided with additional winding turns, i.e., more turns than the total primary winding, if it is necessary to provide a higher level output signal.

Therefore, it is an object of the present invention to provide an output transformer for push-pull power amplifiers having at least a portion of two primary windings arranged coextensively and having the output winding arranged substantially coextensively with one of the two primary winding halves.

It is another object of the present invention to provide an output transformer, wherein the "center tap" ends of each primary half are physically offset one from another.

DETAILED DESCRIPTION OF THE INVENTION

Figure 1:
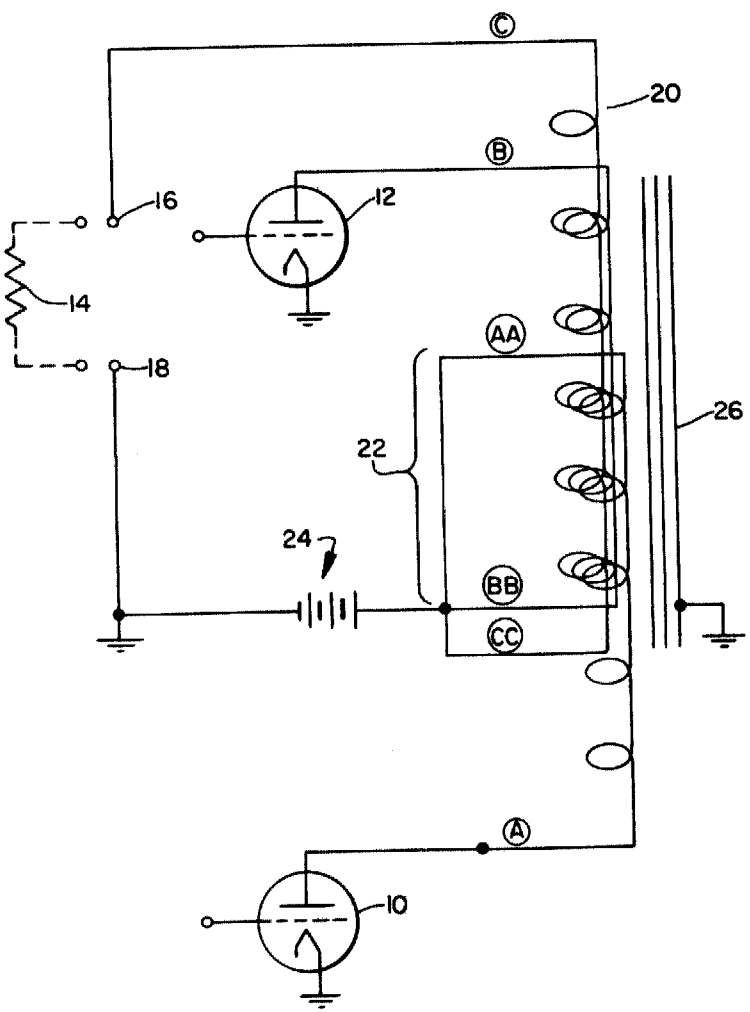
FIG. 1 is a circuit diagram in schematic form of a push-pull amplifier employing the inventive transformer.

Referring now to FIG. 1, the inventive output transformer is shown schematically and connected for push-pull operation with a class B power amplifier. The present invention is suitable for use in a push-pull amplifier operating in any class of operation; class B is presented herein by way of example only. In FIG. 1 the manner in which the inventive windings are physically interrelated is shown. The winding portion extending from A to AA (A–AA) is that half of the primary winding for use by power tube 10. Similarly, the portion of the winding extending from B to BB (B–BB) is that half of the primary winding utilized by power tube 12. The winding portion extending from C to CC (C–CC) is the secondary or "load" winding to which the load, represented by a resistor 14, is connected across points 16 and 18. The present invention is particularly advantageous for use in modulating the DC power input to a radio frequency (RF) power amplifier, and such RF power amplifier could be connected across terminals 16 and 18. This type of modulation is known as constant current modulation and has also been called Heising modulation, after its inventor, R. A. Heising. Of course, the present invention can also be utilized as a wideband balun, which serves to couple a balanced source to a single ended or unbalanced load.

The present invention also contemplates providing the load winding C-CC with additional turns, represented by the additional single turn 20 in the winding C-CC. These additional turns may be needed in the event that an output voltage greater than the input voltage is desired.

FIG. 1 shows schematically the actual physical relationship between the two primary winding halves and specifically shows the manner in which the "center tap" ends of each primary half are offset. Such offset involves both a physical and electrical distance, represented at 22 between the "center tap" AA of winding A-AA and the "center tap" BB of winding B-BB. Additionally, it can be seen from FIG. 1 that the two primary windings, A-AA and B-BB, are specifically arranged so as to be in proximity one to another so that close, tight electrical and magnetic coupling is accomplished. By concentrating the coupling in this manner, i.e., by arranging the two primary windings so that there is a low interwinding voltage between corresponding points on the two winding halves, the bandwidth of the inventive transformer is improved due to the resultant reduction in circulating capacitive currents. Additionally, the improved coupling reduces the leakage inductance and thereby reduces switching transient related distortion and improves performance of the power amplifier tubes 10 and 12 when they are operated in class B.

FIG. 1 also shows the important relationship between the secondary winding C-CC and one of the primary input winding halves, which in this embodiment is winding B-BB. It may be seen that the secondary winding C-CC is wound substantially coextensively with the selected input winding B-BB, thus, during the nonconductive state of tube 12, these windings have the same voltage impressed across them. The biasing voltage for this push-pull amplifier circuit is provided in the conventional manner by a suitable DC power supply, shown schematically as a battery 24.

In the embodiment of FIG. 1, the transformer core 26 is connected as in any conventional transformer, i.e., it is grounded. The effect of the core 26 being grounded is that the windings to the core must withstand the voltage stresses caused by the DC potentials required by the circuit.

Figure 2:
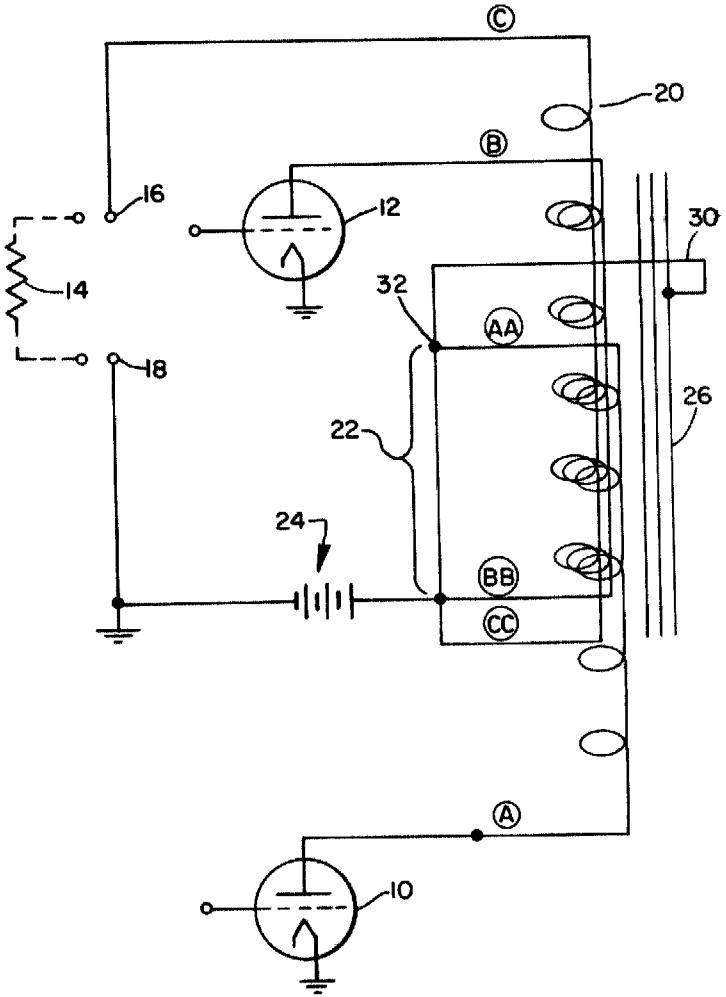
FIG. 2 is the circuit of FIG. 1 having the transformer core specially connected.

FIG. 2 then shows the present invention, wherein the core 26 of the inventive transformer is tied by line 30 to the center of the primary windings and to the low potential terminal of the secondary winding at point 32, and the complete transformer assembly is placed on insulating material above ground. In this fashion the voltage gradient between all windings and the core has been reduced. Now, instead of the windings to the core withstanding the voltage stresses caused by the DC potential of the circuit, this DC potential is developed across the insulating materials that support the transformer assembly above ground.

Figure 3:
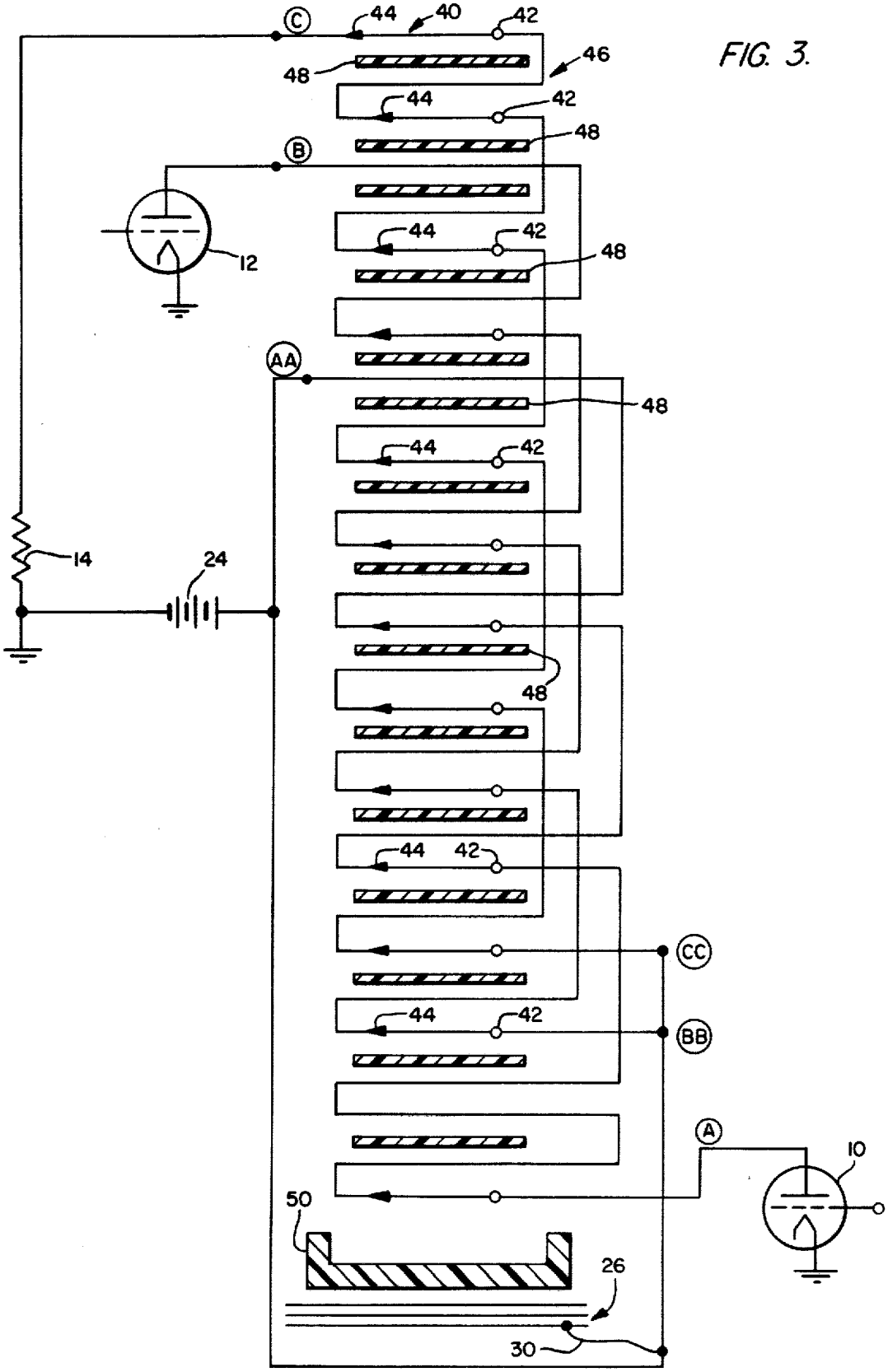
FIG. 3 is a schematic representation of the output transformer of FIG. 2.

Referring now to FIG. 3, the inventive transformer is shown in a pictorial fashion, with the windings being shown schematically. This diagram is intended to be a physical representation of the embodiment shown electrically in FIG. 1. In the embodiment of FIG. 2 it is necessary that the numbers of layers, the total number of turns, the turns per layer, and the current carrying capability of each winding must all be compatible with the required physical structure. Of course, it is also required that the construction parameters be consistent with the desired performance characteristics. In FIG. 3, the transformer includes winding layers, shown schematically at 40 by a straight line originating from a circle 42 and terminating at an arrowhead 44. The embodiment of FIG. 3 includes cross-layer jumper elements, shown typically at 46, which interconnect the adjacent layers and are schematically shown making this interconnection by emanating from an arrowhead 44 and terminating at the circle 42. The required interlayer insulation elements are shown in cross section typically at 48 and are formed of plastic bonded fiberglass or other conventional kinds of interlayer insulation. The inventive transformer is wound on a conventional bobbin 50 which is mounted on the core of the transformer 26. The core 26 is connected to the electrical center of the primary winding by line 30.

In FIG. 3 it may be seen that each winding layer 40 is arranged in the same direction, as indicated by the arrowheads 44. Thus, the cross-layer jumpers 46 are necessary in order to permit each successive layer to start from the same side of the transformer winding structure. By arranging the winding layers in this manner, a winding is produced in which all layers traverse in the same direction, e.g., from right to left in FIG. 3. Therefore, the voltage between layers at all points along the traverse is equal to the end-to-end voltage of a single layer. This is in direct contrast to conventionally arranged transformers, wherein the winding traverse would be reversed at the end of each layer. In the conventional transformer, the end-to-end voltage of a single layer would rise from zero to twice the single-layer voltage. The present invention provides an essentially "flat" voltage distribution, which results in a reduction of the circulating volt amperes in the interlayer capacity. It is known in transformer design that circulating volt amperes are proportional to $E^2$. This distinct advantage of a flat voltage distribution is not found in conventional output transformers.

Moreover, not only does arranging the winding layers in the same traverse direction result in a minimum of interlayer circulating volt amperes, but it also advantageously provides maximum inductive coupling between the windings. It may be seen from FIGS. 1 and 2, that all of the windings are at the same DC potential, as set by the power supply (battery) 24. The AC voltage or audio voltage which had been impressed on the primary windings A-AA and B-BB builds up in opposite directions, in accordance with the conventional operating practice of push-pull amplifiers. In conventional winding configurations, such alternate AC voltages result in a winding layer with the highest AC voltage arranged adjacent a winding layer with the lowest AC voltage. However, in the inventive output transformer, the two primary winding "center taps" AA and BB, are offset so that a lower layer-to-layer voltage exists between these two windings. Additionally, referring to FIG. 3, it may be seen that the secondary winding C-CC is wound layer for layer with the selected one of the primary windings B-BB so that a zero voltage difference also exists between it and the selected primary winding. Thus, the same voltage difference between the secondary winding is present with respect to the nonselected primary winding, A–AA, as exists between the two primary winding segments A–AA and B–BB.

In the drawings it is to be noted that the two primary windings at points AA and BB have equal AC voltages, i.e., the voltage that exists at the second layer away from the zero voltage point. Therefore, it may be seen that at the layer stacks on each side of the center stack, represented by the layers between points AA and BB, the maximum voltage difference will be that which is developed across only three layers. If this five layer stack winding were arranged in the usual conventional configuration, then the maximum voltage difference would be developed across five layers, not the three layers as in the present invention. This reduced layer to layer voltage permits the use of thinner insulation between the layers, thereby further increasing the desired winding to winding coupling.

It is understood, of course, that the foregoing is presented by way of example only and is not intended to limit the scope of the present invention, except as set forth in the following claims.

What is claimed is:

1. An output transformer of the type for use in audio power amplification, comprising:

first and second input windings of substantially equal inductance and being arranged contiguously with the same winding sense for a portion but not all of their total winding length;

such that one end of said first input winding is physically offset from the corresponding end of said second input winding;

an output winding having the same winding sense as said first and second input windings and being arranged contiguously over the entire length of and extending beyond only one end of only one of said first and second input windings; and said windings all being arranged on a common core.

2. The transformer of claim 1, wherein said output winding includes a number of turns differing from the number of turns of said first and second input windings.

3. The transformer of claim 1, wherein the center leads represented by said one end and said corresponding end of said first and second input windings, respectively, and the low voltage end of said output winding are electrically connected at a common point.

4. The transformer of claim 3, wherein said common core is electrically connected to said common point whereat said first and second input windings and said output winding are interconnected.

5. A transformer for connection in push-pull relation with a pair of push-pull amplifier elements comrising:

a first primary winding, a second primary winding, and a secondary winding, said first and second primary windings, wound in identical sense and being arranged in superposition for a portion of but less than the total length of one primary winding, said first and second primary windings being arranged such that one end of said first primary winding is physically offset from the corresponding end of said second primary winding, said secondary winding being arranged contiguously with the same winding sense over the entire length of and extending beyond only one end of only one of said first and second primary winding, and said windings all arranged on a common core.

6. The transformer of claim 5, wherein said first and second primary windings have an equal number of turns and the center leads thereof are electrically connected with one end of said secondary winding.

7. The transformer of claim 6, wherein said secondary winding has a number of turns differing from said first and second primary windings.

8. The transformer of claim 6, wherein said common core is electrically connected with the center leads of said first and second primary windings and the one end of said secondary winding.

9. A transformer comprising:

first and second input windings and an output winding formed as a plurality of winding layers arranged to traverse the same direction, said plurality of winding layers forming said first and second input windings are arranged such that a portion of but not all of said layers are arranged coextensively, said plurality of winding layers forming said output winding are arranged coextensively with and extending beyond only one end of only one of said first and second input windings;

a plurality of cross-layer jumpers for electrically interconnecting selective ones of said winding layers to form said first and second input windings and said output winding, said jumpers being arranged so that one end of said first input winding is offset from the corresponding end of said second input winding;

a plurality of inter-layer insulation elements arranged between successive winding layers whereby said layers are electrically insulated one from another;

a bobbin on which said layers, said jumpers and said insulation elements are arranged, whereby the voltage between said adjacent layers at all points along the traverse of said layers is proportional to the ratio of the end-to-end voltages of a single layer; and said bobbin being mounted on a core.

10. The transformer of claim 9, wherein said plurality of winding layers forming said first and second input windings each having two terminals for electrical connection, and said layers further forming said output winding having two terminals for electrical connection.

11. The transformer of claim 10, wherein the center terminals of said first and second input windings are directly electrically connected at a common point with one of said two terminals of said output winding.

12. The transformer of claim 11, wherein said core is electrically connected to said common point.

* * * * *